United States Patent [19]

Reed, Jr.

[11] Patent Number: 4,799,980

[45] Date of Patent: Jan. 24, 1989

[54] MULTIFUNCTIONAL POLYALKYLENE OXIDE BINDERS

[76] Inventor: Russell Reed, Jr., 2026 Mono St., Ridgecrest, Calif. 93555

[21] Appl. No.: 149,283

[22] Filed: Jan. 28, 1988

[51] Int. Cl.[4] ..... C06B 45/10

[52] U.S. Cl. ..... 149/19.4; 149/19.6; 523/180; 524/186; 524/259; 528/76; 528/77; 528/419

[58] Field of Search ..... 149/19.4, 19.6; 523/180; 528/76, 77, 419; 524/259, 186

[56] References Cited

U.S. PATENT DOCUMENTS

| | | | |
|---|---|---|---|
| 2,706,189 | 4/1955 | Pruitt et al. | 528/412 |
| 3,004,840 | 10/1961 | Pruitt et al. | 149/19.4 |
| 3,049,515 | 8/1962 | Damuss | 524/259 |
| 3,132,976 | 5/1964 | Klager et al. | 149/19.4 |
| 3,350,245 | 10/1967 | Dickinson | 149/19 |
| 3,419,510 | 12/1968 | Hudak | 260/18 |
| 3,505,373 | 4/1970 | Olberg et al. | 149/19.4 |
| 3,529,042 | 9/1970 | Loppet et al. | 149/19.4 |
| 3,792,003 | 2/1974 | Duchesne | 260/18 TN |
| 3,793,099 | 2/1974 | Duerkson et al. | 149/19.4 |
| 3,888,707 | 6/1975 | Rothenstein | 149/19.4 |
| 3,956,890 | 5/1976 | Davis | 149/19.4 X |
| 3,976,522 | 8/1976 | Rothenstein | 149/19.4 |
| 4,000,023 | 12/1976 | Oberth et al. | 149/19.4 |
| 4,092,188 | 5/1978 | Cohen et al. | 149/19.4 |
| 4,099,376 | 7/1978 | Japs | 60/253 |
| 4,163,681 | 8/1979 | Rothenstein et al. | 149/19.4 X |
| 4,184,031 | 1/1980 | Graham et al. | 149/19.4 |
| 4,209,605 | 6/1980 | Hoy et al. | 528/77 |
| 4,234,364 | 11/1980 | Robinson, Jr. | 149/19.4 |
| 4,235,765 | 11/1980 | Gallagher et al. | 524/156 |
| 4,263,070 | 4/1981 | Price et al. | 149/19.4 |
| 4,275,244 | 6/1981 | Helfert et al. | 528/419 |
| 4,296,212 | 10/1981 | Ewen et al. | 528/77 |
| 4,376,834 | 3/1983 | Goldwasser et al. | 528/77 |
| 4,379,903 | 4/1983 | Reed, Jr. et al. | 528/77 |
| 4,379,904 | 4/1983 | Ehrlich et al. | 528/77 |
| 4,394,329 | 7/1983 | Barnes | 149/19.4 |
| 4,403,083 | 9/1983 | Marans et al. | 528/76 |
| 4,476,252 | 10/1984 | Esselborn et al. | 528/77 X |
| 4,530,941 | 7/1985 | Turner et al. | 528/77 |
| 4,638,735 | 1/1987 | Lelu et al. | 149/19.4 X |
| 4,650,617 | 3/1987 | Kristofferson et al. | 149/19.4 |
| 4,670,068 | 6/1987 | Chi | 149/19.4 |
| 4,706,567 | 11/1987 | Schmid et al. | 149/19.4 |
| 4,726,919 | 2/1988 | Kristofferson et al. | 149/19.4 |

*Primary Examiner*—Edward A. Miller
*Attorney, Agent, or Firm*—William C. Townsend; Melvin J. Sliwka; Stephen J. Church

[57] ABSTRACT

An improved multifunctional polyalkylene oxide binder is obtained by tailoring the cross-linking with a multifunctional polyol having a functionality of 3 or more and a molecular weight from about 12,000 to about 27,000 daltons. The binder is useful in forming castable propellants and plastic-bonded explosive compositions having high tensile strength and elongation and low volume dilatation.

12 Claims, No Drawings

MULTIFUNCTIONAL POLYALKYLENE OXIDE BINDERS

BACKGROUND OF THE INVENTION

1. Field of the Invention

This invention relates to castable composite rocket propellants and plastic bonded explosive compositions. More particularly, this invention relates to energetic compositions containing an improved polyalkylene oxide binder.

2. Description of the Prior Art

Elastomeric binders are used in desensitizing energetic compositions. Binders that contribute to enhanced toughness have been found to improve the general hazard sensitivities of high energy rocket propellants. An increase in toughness, as measured by tensile strength and elongation, of plastic-bonded explosives will decrease the hazard sensitivities particularly to those stimuli which cause an increase in the surface area.

Hydroxyl-terminated polyalkylene oxides having a molecular weight of about 4500 and a functionality of 2 are known in the art of elastomeric binder formulations used to produce propellents and explosives. Difunctional polyalkylene oxide polymers with longer chain lengths aparently do not enhance toughness because the cross-link density becomes too low and the compositions become excessively soft. It is also known that cross-linking of the polyalkylene oxide improves the mechanical properties of the binder. Because of the low functionality of the polyether binder material it is necessary to use isocyanate curatives having functionalities greater than 2 in order to obtain adequate cross linking of the polyethers. Such multifunctional isocyanate curatives cannot be obtained as pure compounds and often vary in quality. These variations and impurities adversely affect the mechanical properties and the reliability of the propellant binder formulations.

Polyalkylene oxide triols having molecular weights from about 1000 to about 2400 are known as cross-linkers for propellant binder compositions consisting essentially of difunctional polyalkylene oxides of the same molecular weight. Similarly, polyalkylene oxide triols having a molecular weight between about 3500 and 4500 are known as cross-linkers for propellant binder compositions consisting essentially of difunctional hydroxyl-terminated polybutadienes of the same molecular weight. Formulations containing these low to moderate molecular weight polyalkylene oxide diols and triols have tensile strengths of 75 to 100 psi or more and elongations at maximum stress of over 300%. Onset of volume dilatation occurs in these formulations at levels of strain of about 3% to about 7%.

Castable high energy composite rocket propellant compositions and plastic bonded explosive compositions contain high levels of plasticizer not only to enhance energy but also to improve rheological properties during processing, to prevent crystallization after curing, and to improve low temperature properties of the cured compositions. However, high levels of plasticizers weaken binder strength. Consequently, binder formulations having improved mechanical properties are needed to offset the weakening effects of high plasticizer levels.

SUMMARY OF THE INVENTION

An improved multifunctional polyalkylene oxide binder is obtained by tailoring the cross-linking with a multifunctional polyol having a functionality of 3 or more and a molecular weight from about 12,000to about 27,000 daltons. When apropriate amounts of an energetic additive or oxidizer are added to the binder, particularly useful castable propellants and plastic-bonded explosives having high tensile strength and elongation and low volume dilatation result.

It is an object of this invention to provide an improved multifunctional polyalkylene oxide binder which will contribute to such properties as high tensile strength and elongation together with low volume dilatation in energetic compositions.

Another object of this invention is to provide a propellant binder which is compatible with high levels of plasticizer.

Other features and advantages of the present invention will become apparent from the following detailed description.

DETAILED DESCRIPTION OF THE INVENTION

According to the present invention, the class of polymers producing binders with the highest combination of elongation and tensile strength are trifunctional polyalkylene oxides ranging in molecular weight from 12,000 daltons to 27,000 daltons. These polymers have a tri-star configuration. Tetra-star polymers of the same molecular weights are also useful. Mixtures of the tristar and tetra-star polymers as well as mixtures of those polymers and lower molecular weight difunctional polyalkylene oxides can be used to tailor mechanical properties. Additionally, lower molecular weight difunctional polyalkylene oxides may be used to improve the rheological properties of the high molecular weight tri and tetra functional polyalkylene oxides.

The multifunctional polyalkylene oxides consist primarily of oxyethylene with a lesser amount of oxypropylene. The multifunctional polyalkylene oxides are available from BASF Wyandotte of Wyandotte, Michigan under the designations PAO 24-17, PAO 21-63, PAO 2437, and PAO 24-13. In one embodiment of the present invention, the polyalkylene oxide is a random copolymer of oxyethylene and oxypropylene. This is particularly desirable because the randomness helps to effectively dissolve the nitrate ester plasticizer. Although block copolymers may be used, they are not especially well suited for the present invention because they lack the randomness to effectively dissolve the large amounts of nitrate ester plasticizers used in energetic compositions.

Aliphatic, cycloaliphatic, and aromatic isocyanate curatives can be used as the urethane cross-linker. Although multifunctional isocyanate curatives may be used, the subject multifunctional polyalkylene oxide binder has the advantage of not being limited to multifuctional isocyanate curatives. Although the binders of the present invention can use any difunctional isocyanate curative, the tetra-star polymer configuration is preferred with difunctional isocynates. These difunctional isocyanates can be obtained as pure compounds, thus avoiding the unpredictable quality and results associated with multifunctional isocyanate curatives. Pure starting materials improve the mechanical properties of the binder.

The following isocyanate curatives have been found to work well in the present invention: the biuret trimer of hexamethylene diisocyanate, 3-nitraza-1.5,-pentane diisocyanate, isophorone diisocyanate, tris(-4bisocyanatophenyl) thiophosphate, 2,4-toluene diisocyanate, and hexamethylene diisocyanate. The biuret trimer of hexamethylene diisocyanate is the preferred isocyanate curative because it is readily available, has generally acceptable reproducibility, contributes to a reasonable pot life, and is easily transferred to the mix. This compound has the trade designation Desmodur N-100 and is sold by the Mobay Chemical Company.

The best results have been achieved when the isocyanate curative is added in an amount so that the isocyanate/hydroxyl group equivalent ratio (NCO/OH) is in the range from about 1.8 to about 3.0.

Nitrate ester plasticizers are used in the present invention to provide energy to the compositions in the form of nitrato groups. Other plasticizers may be used provided they are miscible with the polyalkylene oxide. The nitrate ester plasticizers 1,2,4-butanetriol trinitrate, trimethylolethane trinitrate, and a mixture of bis(2,2-dinitropropyl) formal and acetal work well in the present invention. 1.2,4-Butanetriol trinitrate is preferred because it is more energetic and because it enhances rheological properties during processing.

The ratio of plasticizer to polymer ($P_1/P_0$) may be varied to affect the rheological properties of the mix during processing and the energetic performance characteristics of the cured composition. The $P_1/P_0$ ratio may range from about 1.8. to about 4. Ratios of about 4 are desirable because they provide better performance characteristics, but such ratios are difficult to achieve because nitrate ester plaszticizers such as 1,2,4-butanetriol trinitrate are not well retained by the polyalkylene oxide at this concentration. A $P_1/P_0$ from about 2.6 to about 3.0 is preferred to obtain good rheological properties.

Any conventional catalyst which is known to be useful in accelerating the reaction of isocyanate groups with hydroxyl groups to produce urethane is suitable. Among these, the tin-II salts of carboxylic acids and the dialkyltin IV salts of carboxylic acids are suitable. Dibutyltin dilaurate has been found to work particularly well.

The reactants are combined in equimolar amounts. An excess of the isocyanate added when additional pasticizer was used generally improved the results. The reaction takes place at temperatures of 50°-60° C. for a period of 4-5 days using dibutyl tin dilaurate catalyst.

The polyalkylene oxide binder of the present invention is especially useful in solid energetic compositions when combined with a solid organic energetic material. Cyclotetramethylenetetranitramine (HMX) in amounts up to about 75 percent by weight works well with the binder of the present invention. HMX having a particle diameter of about 10 microns or less was found to work particularly well in providing a solid energetic composition possessing superior mechanical properties. Mixtures of HMX having particle diameters of about 10 microns and about 2 microns provide composite propellants having superior mechanical properties. In a preferred embodiment of the present invention, a composite containing about 55% by weight 10 micron particle diameter HMX and about 10% by weight 2 micron particle diameter HMX provided excellent results.

Propellants having superior mechanical properties are less likely to undergo granulation when motors containing such propellants are subjected to shear stresses occurring when the motor case ruptures. In such cases, high energy propellants containing nitrate ester plasticizers have been observed to undergo a transition from burning to detonation, particularly in large rocket motors. The improved binder increases shelf life of propellants since the limiting factor of shelf life is degradation of mechanical properties. The improved binder also improves propellant resistance to impact and shock.

The compositions and mechanical properties of solid energetic compositions containing polyalkylene oxide binders of the present invention are given in Table 1. Table 1 also contains compositions and mechanical properties for currently used difunctional polyethylene oxides and for a conventional plastic bonded explosive formulation.

TABLE 1

| Polymer (Po) | EW | F | Isocyanate | NCO/OH | Plasticizer (PI) | HMX (10 μm), % | $E_o$, psi | $S_m$, psi | $\epsilon_m$, % | $\epsilon_b$, % | $St_m$, psi | Strain energy, in-lb/in$^3$ |
|---|---|---|---|---|---|---|---|---|---|---|---|---|
| 24-17 | 5800 | 3.0 | RF | 2.5 | BDNPA/F | 60 | 146[b] | 67 | 719 | 735 | 549 | 1124 |
| | | 3.0 | N100 | 1.8 | BTTN | 60 | 51[b] | 42 | 813 | 814 | 383 | 855 |
| 21-63 | 6667 | 3.0 | N100 | 2.5 | BTTN | 60 | 80[b] | 113[11] | 781 | 782 | 995 | 2019 |
| | | 3.0 | N100 | 2.0 | BTTN | 55 | 60[b] | 75 | 775 | 776 | 652 | 1039 |
| | | 3.0 | N100 | 1.5 | BTTN | 60 | 40[b] | 54 | 777 | 778 | 477 | 958 |
| | | 3.0 | XIII-D | 1.8 | BTTN | 60 | 85[b] | 53 | 726 | 727 | 438 | 1257 |
| | | 3.0 | XIII-D | 1.5 | BTTN | 60 | 75[b] | 64 | 972 | 973 | 530 | 1809 |
| 24-37 | 9200 | 3.0 | N100 | 2.0 | BTTN | 60 | 70[b] | 41 | 939 | 939 | 426 | 1053 |
| | | 3.0 | RF | 2.5 | BTTN | 60 | 34[b] | 93 | 748 | 780 | 799 | 1807 |
| 24-13 | 4500 | 4.0 | N100 | 2.0 | BTTN | 50 | 174[b] | 60 | 473 | 472 | 346 | 578 |
| E4500 | 2250 | 2.0 | N100 | 1.5 | BTTN | 64 | 120[b] | 65 | 301 | 301 | 259 | 328 |
| E4500 | 2250 | 2.0 | N100 | 1.8 | BDNPA/F | 60 | 192 | 58 | 224 | 225 | 187 | 212 |
| E8000 | 4000 | 2.0 | N100 | 1.5 | BTTN | 65 | [c] | [c] | [c] | [c] | [c] | |

TABLE 1-continued

| Polymer (Po) | EW | F | Isocyanate | NCO/OH | Plasticizer (PI) | HMX (10 μm), % | $E_o$, psi | $S_m$, psi | $\epsilon_m$, % | $\epsilon_b$, % | $St_m$, psi | Strain energy, in-lb/in$^3$ |
|---|---|---|---|---|---|---|---|---|---|---|---|---|
| PBXN-106 | 4500 | 2.0 | TDI | — | BDNPA/F | 75[e] | — | 48 | 10 | 10 | — | <10 |

[a]RDX.
[b]Mini-dogbone was pulled to the extension limit but did not break.
[c]Too soft, no data.
HMX, cyclotetramethylenetetranitramine;
RDX, cyclotrimethylenetrinitramine;
BTTN, 1,2,4-butanetriol trinitrate;
RF, tris(4-isocyanatophenyl) thiophosphate;
N100, biuret trimer of hexamethylene diisocyanate;
XIII-D, 3-nitraza-1,5-pentane diisocyanate;
BDNPA/F, bis(2,2-dinitropropyl) acetal/formal (50/50 mixture);
NCO/OH, equivalent ratio of isocyanate to hydroxyl;
EW, equivalent weight;
F, functionality;
E4500 and E8000, difunctional polyethylene oxides available from Dow Chemical Company, Midland, Michigan;
PBXN-106, plastic bonded explosive containing polyethylene oxide having an average molecular weight of 3200;
$S_m$, maximum tensile strength;
$St_m$, corrected stress (for decrease in cross-sectional area)
$E_o$, initial modulus;
$\epsilon_m$, strain at maximum tensile stress;
$\epsilon_b$, elongation at break.

Formulations of energetic compositions containing about 65% by weight cyclotetramethylenetetranitramine and using the polyalkylene oxide binders of the present invention are given in TABLE 2.

TABLE 2

| | Composition, wt. % | | | | |
|---|---|---|---|---|---|
| | DRX-1 | DRX-2 | DRX-3 | DRX-4 | DRX-6 |
| PAO 24-17 | 8.32 | 8.24 | 8.17 | | 8.063 |
| PAO 24-13 | | | | 8.29 | |
| BTTN | 26.25 | 26.25 | 26.25 | 26.25 | 26.25 |
| N100 | 0.43 | 0.51 | 0.58 | | 0.687 |
| MDI | | | | 0.46 | |
| T-12(× $10^{-3}$) | 1.0 | 1.7 | 1.7 | 0.7 | 1.3 |
| HMX,10 μm | 65.00 | 65.00 | 65.00 | 65.00 | 65.00 |
| NCO/OH | 1.8 | 2.2 | 2.5 | 2.0 | 3.0 |
| EOM viscosity | 25 | 24 | 24 | [c] | 21 |

(58–60° C.)

Mechanical properties of these compositions cured with the biuzet trimer of hexamethylene diisocyanate are given in Table 3. As can be seen from Table 3, formulations with a NCO/OH ratio of at least 2.5 have superior mechanical properties. Compositions DRX-3 and DRX-6 are suitable for propellants while others with lower values of modulus and dilitation may be useful for explosive compositions.

TABLE 3

| Composition | NCO/OH | $E_o$, psi | $S_m$, psi | $\epsilon_m$, % | $\epsilon_b$, % | $S_{tm}$, psi | Strain energy, in-lb/in$^3$ |
|---|---|---|---|---|---|---|---|
| DRX-1 | 1.8 | 130[a] | 19 | 349 | 360 | 87 | 152 |
| DRX-2 | 2.2 | 149[a] | 25 | 349 | 361 | 113 | 189 |
| DRX-3 | 2.5 | 157[a] | 114[a] | 1000[b] | 1010[b] | 1254 | 2600[b] |

TABLE 3-continued

| Composition | NCO/OH | $E_o$, psi | $S_m$, psi | $\epsilon_m$, % | $\epsilon_b$, % | $S_{tm}$, psi | Strain energy, in-lb/in$^3$ |
|---|---|---|---|---|---|---|---|
| DRX-6 | 3.0 | 191[a] | 123[b] | 1000[b] | 1022[b] | 1398[b] | 2805[b] |

[a]Instron data with minibones
[b]Sample did not break in Instron. Data attained for samples which were pulled to rupture.

Mechanical properties derived from simultaneous stress-strain and volume dilatation measurements are reported in Table 4. These results are reported for compositions using the polyalkylene oxide binders of the present invention as well as for a typical high elongation propellant and for two plastic-bonded explosive formulations.

TABLE 4

| Sample | $E_o$, psi(MPa) | $\epsilon_m$, cm/cm | $\sigma^{TC}$, psi(MPa) | $\epsilon_{OD}$, cm/cm | $\sigma_{OD}^{TC}$, psi(Mpa) | Final dilatation volume, % |
|---|---|---|---|---|---|---|
| DRX-1[a] | 144(0.99) | 5.40 | 181(1.25) | 1.60 | 32(0.22) | 3.5 |
| DRX-2[a] | 154(1.06) | 5.23 | 207(1.43) | 1.25 | 38(0.26) | 6.5 |
| DRX-3 | 305(2.10) | 5.20 | 278(1.92) | 0.80 | 35(0.24) | 27.0 |
| Typical high elongation propellant | 458(3.16) | 2.54 | 178(1.23) | 0.45 | 46(0.32) | 16.0 |
| PBXN-107 | 1885(13.0) | 0.22 | 45(0.31) | 0.04 | 39(0.27) | 3.91 |
| PBXN-109 | 1450(10.0) | 0.11 | 128(0.88) | 0.07 | 96(0.66) | 0.43 |

[a]Sample not pulled to failure.
$\sigma$ Stress
$\sigma_{TC}$ True corrected stress As shown in Table 4, DRX-1 and DRX-2 have low dilatation. DRX-3 has a dilatation value lower than that of typical high elongation rocket propellants; moreover, this occurs at much higher values of elongation in the case of DRX-3.

Compositions and mechanical properties for some energetic compositions made with the polyoxyalkylene binder of the present invention are given in Table 5. All the compositions reported in Table 5 use 1,2,4-butanetriol trinitrate plasticizer and contain dibutyltin dilaurate catalyst.

TABLE 5

| Polymer | Isocyanate | NCO/OH | $P_1/P_0$ | HMX % (10 μM) | $S_m$ psi | $E_m$ % | $E_m$ % |
|---|---|---|---|---|---|---|---|
| PAO 21-63 | N-100 | 1.50 | 3 | 64 | 65 | 301 | 301 |
| PAO 21-63 | XIII-D | 1.50 | 2.45 | 62 | 104 | 548 | 558 |
| PAO 21-63 | N-100 | 2.50 | 3 | 65 | 113 | 781 | 782 |

TABLE 5-continued

| Polymer | Isocyanate | NCO/OH | $P_1/P_0$ | HMX % (10 μM) | $S_m$ psi | $E_m$ % | $E_m$ % |
|---|---|---|---|---|---|---|---|
| PAO 21-63 | N-100 | 2.50 | 3 | 55 | 98 | 872 | 873 |
| E4500 | N-100 | 1.80 | 3 | 25 | 34 | 254 | 255 |
| PAO 21-63 | XIII-D | 2.50 | 3 | 25 | 60 | 707 | 708 |

*$P_1/P_0$ = plasticizer to Polymer ratio

The following examples are provided to illustrate but not limit the present invention

EXAMPLE 1

A propellant formulation with superior mechanical properties is obtained by reaction of a solution of the multifunctional polyalkylene oxide PAO 24-17 in the plasticizer BTTN with the multifunctional isocyanate curative Desmodur (N-100), the biuret trimer of hexamethylene diisocyanate. The resulting binder was used to form a cyclotetramethylenetetranitramine (HMX) composite propellant. The propellant contained about 55% by weight 10 micron HMX particles and about 10% by weight 2 micron HMX particles. The resulting composite propellant material has an elongation of 1030% and a maximum stress of 137 psi.

EXAMPLE 2

A binder formulation containing no energetic filler material was prepared from PAO 21-63 and the difunctional isocyanate 3-nitraza-1,5-pentane diisocyanate. Sufficient isocyanate curative was added so that the NCO/OH ratio was 1.0. The energetic plasticizer 1,2,4-butanetriol trinitrate was added so that the plasticizer to polymer ratio was 0.2 by weight. The resulting binder material had the following properties: Initial modulus 24 psi, stress 89 psi, strain at maximum tensile stress 709%, elongation at break 711%, corrected stress (for decrease in cross sectional area) 719 psi, and strain energy 1886 in-lbs/in$^3$.

Modifications and variations of the present invention are possible. It should be understood that, within the scope of the appended claims, the invention may be practiced otherwise than as specifically described.

What is claimed is:

1. In an energetic composition having a polyalkylene oxide binder and a nitrate ester plasticizer, the improvement comprising said binder being formulated from a polyalkylene oxide having a tri-star or a tetra-star configuration and having a molecular weight from about 12,000–27,000 daltons.

2. The energetic composition of claim 1 further comprising a difunctional isocyanate curative.

3. The energetic composition of claim 2 wherein said curative is present in an amount such that the NCO/OH equivalent ratio is from about 1.8 to about 3.0

4. The energetic composition of claim 1 wherein said polyalkylene oxide is a random copolymer of oxyethylene and oxypropylene.

5. The energetic composition of claim 1 further comprising about 50 to about 75 percent by weight of a solid energetic additive.

6. A curable mixture comprising:

from about 32 to about 82 percent by weight of a polyalkylene oxide having a tri-star or tetra-star configuration and a molecular weight from about 12,000 to about 27,000 daltons;

from about 0.5 to about 1.8 percent by weight of an isocyanate curative, said isocyanate curative present in an amount so that the NCO/OH equivalent ratio is from about 1.8 to about 3.0;

from about 17 to about 67 percent by weight of a nitrate ester plasticizer; and a catalyst selected from the group consisting of tin-II salts of carboxylic acids and dialkyltin-IV salts of carboxylic acids.

7. The curable mixture of claim 6 wherein said polyalkylene oxide is a random copolymer consisting essentially of oxyethylene and a lesser amount of oxypropylene.

8. The curable mixture of claim 6 wherein said isocyanate curative is selected from the group consisting of the aliphatic biuret trimer of hexamethylene diisocyanate, 3-nitraza-1,5pentane diisocyanate, isophorone diisocyanate, tris(4-isocyanatophenyl) thiophosphate, 2,4-toluene diisocyanate, and hexamethylene diisocyanate.

9. The curable mixture of claim 6 wherein said nitrate ester plasticizer is selected from the group consisting of 1,2,4-butanetriol trinitrate, trimethylolethane trinitrate, and a mixture of bis(2,2-dinitropropyl) formal and acetal.

10. The curable mixture of claim 6 wherein said catalyst is dibutyltin dilaurate.

11. A solid energetic composition comprising:

from about 6 to about 12 percent by weight of a polyalkylene oxide having a tri-star or tetra-star configuration and a molecular weight from about 12,000 to about 27,000 daltons;

from about 0.4 to about 1.0 percent by weight of an isocyanate curative, said isocyanate curative present in an amount so that the NCO/OH equivalent ratio is from about 1.8 to about 3.0;

from about 20 to about 30 percent by weight of a nitrate ester plasticizer;

from about 50 to about 75 percent by weight of a solid energetic additive; and a catayst selected from the group consisting of tin-II salts of carboxylic acids and dialkyl-tin salts of carboxylic acids.

12. The solid energetic composition of claim 11 wherein said solid energetic additive is cyclotetramethylenetetranitramine having a particle diameter of about 10 microns or less.

* * * * *